US008608865B2

(12) United States Patent
Karls

(10) Patent No.: US 8,608,865 B2
(45) Date of Patent: Dec. 17, 2013

(54) DEVICE AND METHOD FOR DEBURRING AND/OR CLEANING A WORK PIECE DIPPED IN A FLUID MEDIUM

(75) Inventor: Werner Karls, Hürtgenwald (DE)

(73) Assignee: Dürr Ecoclean GmbH, Filderstadt (DE)

( * ) Notice: Subject to any disclaimer, the term of this patent is extended or adjusted under 35 U.S.C. 154(b) by 0 days.

(21) Appl. No.: 12/879,832

(22) Filed: Sep. 10, 2010

(65) Prior Publication Data

US 2011/0056525 A1 Mar. 10, 2011

Related U.S. Application Data

(63) Continuation of application No. PCT/EP2009/052780, filed on Mar. 10, 2009.

(30) Foreign Application Priority Data

Mar. 14, 2008 (DE) ..... 10 2008 015 042

(51) Int. Cl.
*B08B 7/00* (2006.01)
*B08B 7/04* (2006.01)
*B08B 3/02* (2006.01)

(52) U.S. Cl.
USPC ..... 134/36; 134/34; 134/37; 134/95.3; 134/102.1

(58) Field of Classification Search
USPC ..... 134/34, 36, 37, 94.1, 95.3, 102.1, 134/102.2, 7; 451/40, 102
See application file for complete search history.

(56) References Cited

U.S. PATENT DOCUMENTS

| | | | | |
|---|---|---|---|---|
| 2,508,766 | A * | 5/1950 | Morel | 451/102 |
| 4,342,425 | A * | 8/1982 | Vickers | 239/424 |
| 4,555,872 | A * | 12/1985 | Yie | 451/40 |
| 5,155,946 | A * | 10/1992 | Domann | 451/75 |
| 5,626,508 | A * | 5/1997 | Rankin et al. | 451/102 |
| 6,283,833 | B1 * | 9/2001 | Pao et al. | 451/40 |
| 6,837,775 | B2 * | 1/2005 | Anand et al. | 451/38 |
| 2006/0151634 | A1 * | 7/2006 | Pivovarov | 239/526 |

FOREIGN PATENT DOCUMENTS

| | | |
|---|---|---|
| DE | 4310267 | 9/1969 |
| DE | 2046254 | 4/1971 |
| DE | 19529749 | 2/1997 |
| DE | 102004047050 | 12/2005 |
| DE | 102006009468 | 8/2007 |
| GB | 1164448 | 9/1969 |
| GB | 2078546 | 1/1982 |
| WO | 0244020 | 6/2002 |

OTHER PUBLICATIONS

International Searching Authority, International Search Report issued for PCT/EP2009/052780, mailed on Jun. 30, 2009, 6 pages.
German Patent Office, Search Report issued for German patent application No. 10 2008 015 042.8, dated Jun. 27, 2008, 4 pages.

* cited by examiner

*Primary Examiner* — Alexander Markoff
(74) *Attorney, Agent, or Firm* — Hanley, Flight & Zimmerman, LLC.

(57) ABSTRACT

In order to produce a particularly efficient device for deburring and/or cleaning a work piece that is dipped in a fluid medium comprising a fluid discharge device for producing a high pressure fluid jet, it is proposed that the device should comprise a gas discharge device for the production of a gas flow which at least partially envelops the fluid jet.

16 Claims, 2 Drawing Sheets

DEVICE AND METHOD FOR DEBURRING AND/OR CLEANING A WORK PIECE DIPPED IN A FLUID MEDIUM

RELATED APPLICATION

This application is a continuation application of PCT/EP2009/052780 filed Mar. 10, 2009, the entire specification of which is incorporated herein by reference.

FIELD OF DISCLOSURE

The present invention relates to a device for deburring and/or cleaning a work piece dipped in a fluid medium, comprising a fluid discharge device for producing a high pressure fluid jet.

BACKGROUND

Such a device is particularly well suited to the process of deburring and/or cleaning mechanically worked work-pieces, especially machined work-pieces. By subjecting a work piece to a high pressure fluid jet, burrs and/or impurities can be removed from the work piece.

SUMMARY OF THE INVENTION

Based upon such a process, the object of the present invention is to provide a device for deburring and/or cleaning a work piece dipped in a fluid medium which is particularly efficient.

This object is achieved in accordance with the invention by means of a device in accordance with claim 1.

The device in accordance with the invention makes it possible to provide a gas flow which at least partially shields the fluid jet with respect to the fluid medium so that the friction between the fluid jet and the fluid medium can be reduced to a considerable degree. The effect achieved thereby is that the fluid jet is not slowed down or is only slowed down to a slight extent during its movement through the fluid medium in the direction of the work piece. This has the advantage that a fluid jet produced by the device in accordance with the invention has a higher kinetic energy upon impacting the surface of a work piece than is the case for devices known from the state of the art. The deburring and/or cleaning effect can thereby be improved. As an alternative or in addition thereto, the fluid jet can be subjected to a lower pressure, whereby the energy consumption of the device in accordance with the invention is reduced with respect to the devices known from the state of the art whilst maintaining an identical deburring and/or cleaning effect.

It is advantageous for the fluid discharge device to comprise a nozzle or a high pressure nozzle. Such a nozzle makes it possible for fluid to be discharged at a high pressure from the fluid discharge device and thereby form a fluid jet. By appropriate design of the geometry of the nozzle, a fluid jet can be produced which has a substantially fully circular jet profile, or a flat jet profile which is elongate or elliptical.

In order to obtain a deburring and/or a cleaning action that is as highly effective as possible, it is preferable that the beam angle of the fluid jet be as small as possible. A beam angle is to be understood as being the angle between the mutually opposite peripheral boundaries of the fluid jet. Preferably, the beam angle amounts to at most approximately 25°, and in particular, to at most approximately 15°.

The device in accordance with the invention has the further advantage that, with the help of the gas flow in the vicinity of the fluid discharge device, direct contact of the fluid emerging from a nozzle with the fluid medium and consequent damage to the nozzle due to cavitation can thereby be prevented.

The device in accordance with the invention makes it possible to achieve a highly effective deburring and/or cleaning action using just a small amount of energy. Moreover, the device in accordance with the invention enables a work piece to be deburred and/or cleaned in a particularly low-noise and low-emission manner. The gas flow makes it possible for the sound of the high pressure fluid jet on the one hand and the fluid medium on the other to be decoupled. In addition, interaction between the fluid jet and the fluid medium is reduced with the help of the gas flow so that the creation of a spray can be prevented at least insofar as possible. Accordingly, it is possible for the device in accordance with the invention to be able to dispense with an external exhaust system or for such an external exhaust system to be of very small dimensions.

The fluid medium in which the work piece is dipped is preferably a fluid cleaning medium such as water for example.

A container in the form of a tank for example is preferably provided for holding the fluid medium, whereby the volume of the container may amount to between a few liters and several cubic meters. For the purposes of deburring and/or cleaning a work piece, it is not necessary for the latter to be completely dipped in the fluid medium; it suffices for the fluid jet and the gas flow to be capable of being supplied to a portion of a work piece which is dipped in the fluid medium.

The fluid being subjected to a high pressure is preferably water and/or oil and/or an emulsion.

The fluid is preferably subjected to a high pressure that is greater than approximately 100 bar. In particular, the fluid is subjected to a pressure which amounts to between 300 bar and 2700 bar, and in particular, to between 500 bar and 2500 bar.

For the purposes of producing the high pressure, provision is preferably made for a high-pressure pump by means of which a fluid under a high pressure is adapted to be supplied to the fluid discharge device.

Preferably the gas flow is an air flow. This has the advantage that a work piece can be deburred and/or cleaned in emission-free manner.

The gas flow envelops at least a part of the periphery of the fluid jet. It is particularly preferable for the periphery of the fluid jet to be completely enveloped by the gas flow.

In accord with one advantageous embodiment of the invention, the gas flow is adapted to be subjected to pressure. Such an application of pressure has the advantage that collapse of the enveloping gas flow, which at least partially surrounds the fluid jet, is prevented. For example, compressed air can be used for producing the gas flow.

It is particularly preferred that the gas flow be arranged to be subjected to a pressure which corresponds to at least the sum of the ambient pressure of the device and the hydrostatic pressure of the fluid medium which is effective at the height of the gas flow. For example, the pressure of the gas flow amounts to at least approximately 1.1 bar when there is an ambient pressure of 1 bar and the submersion depth is 1 m. Thus, in comparison with the high pressure to which the fluid is subjected, it is sufficient for the gas flow to be subjected to a low pressure which amounts to a maximum of approximately 10 bar for example.

It is advantageous for the device to comprise a housing incorporating a chamber which has at least one fluid inlet to the chamber for the entry of high pressure fluid into the chamber, at least one gas inlet to the chamber for the entry of gas into the chamber and at least one outlet from the chamber for the exit of the high pressure fluid jet and the gas flow. Such a chamber makes it possible for a high pressure fluid and a gas to be introduced into the chamber separately from each other and then to be fed out of the chamber together, namely, in such a manner that the gas flow envelops the fluid jet to at least a partial extent.

Preferably, the chamber comprises just one fluid inlet to the chamber and/or just one outlet from the chamber.

In accord with one advantageous embodiment of the invention, at least a part of the gas is adapted to be introduced into the chamber substantially parallel to the jet axis of the fluid jet. An enveloping gas flow can thereby be produced in a simple manner.

Preferably, the fluid inlet to the chamber and the at least one gas inlet to the chamber are arranged on the same boundary surface of the chamber so that the gas and the fluid are adapted to be introduced into the chamber in a substantially mutually parallel direction in a particularly simple manner.

In accord with one embodiment of the invention, a plurality of gas inlets to the chamber are provided. In particular, these inlets are distributed peripherally around the fluid inlet to the chamber and are preferably arranged mutually equidistantly. With the help of a plurality of gas inlets to the chamber, it is possible to introduce a gas into the chamber in a particularly uniformly distributed manner.

In accord with a further embodiment of the invention, provision is made for the gas inlet to the chamber to be annular and preferably arranged concentrically with respect to the jet axis of the fluid jet. It is thereby possible for the gas to be introduced into the chamber in a particularly uniform manner.

In accord with a further advantageous embodiment of the invention, at least a part of the gas is arranged to be introduced into the chamber in a gas entry direction that is inclined with respect to the jet axis of the fluid jet. This assists the process of producing an envelope-like gas flow which at least partially surrounds the fluid jet.

It is advantageous for the fluid inlet to the chamber and at least one gas inlet to the chamber to be arranged on different boundary surfaces of the chamber. This makes it possible to introduce at least a part of the gas into the chamber in a direction which is inclined with respect to the jet axis of the fluid jet in a particularly simple manner.

In accord with one embodiment of the invention, the inlet direction of the gas into the chamber is perpendicular, and in particular, radial to the jet axis of the fluid jet. This makes it possible to produce a peripherally-closed gas flow envelope.

In accord with a further embodiment of the invention, the inlet direction of the gas into the chamber is tangential to the jet axis of the fluid jet. This assists in the formation of an eddy effect within the chamber in order to form a gas flow envelope which surrounds the fluid jet.

For example, at least a part of the gas can be introduced into the chamber in a direction that is vertical with respect to the direction of the force of gravity i.e. from above and/or from below.

Even when at least a part of the gas is being introduced into the chamber in a direction that is inclined with respect to the jet axis of the fluid jet, a plurality of gas inlets to the chamber and/or an annular gas inlet to the chamber can be provided.

It is preferable that the cross section of the chamber in a direction perpendicular to the longitudinal axis of the chamber should taper towards the outlet from the chamber. This makes it possible for the gas to be guided in the direction of the outlet from the chamber in such a manner that a peripherally-closed gas flow envelope is produced.

The longitudinal axis of the chamber preferably extends in a direction that is substantially parallel to the jet axis of the fluid jet. In particular, the longitudinal axis of the chamber and the jet axis of the fluid jet are aligned with one another. A compact gas discharge device can thereby be created.

It is particularly preferable that at least one chamber boundary be formed such that it is concentric with the jet axis of the fluid jet so that a circular gas flow envelope can be produced.

In particular, the chamber is substantially in the form of a frustum of a cone. Preferably, the angle between the outer surface of the truncated cone and the jet axis of the fluid jet amounts to between 10° and 60°.

It is advantageous for the housing to comprise a first housing part for the disposition of the fluid discharge device and a second housing part which bounds at least a section of the chamber and which is connected to or is connectable to the first housing part. This enables the chamber to be constructed in a particularly simple manner especially if the first housing part and the second housing part are connected to or connectable to one another in releasable manner.

It is advantageous for the first housing part to comprise an inlet for a fluid which is arranged to be supplied to the fluid inlet to the chamber.

It is further preferred that at least one of the housing parts should comprise at least one inlet for a gas which is arranged to be supplied to the at least one gas inlet to the chamber.

Furthermore, the invention relates to a method for deburring and/or cleaning a work piece, in which the work piece is dipped in a fluid medium and is exposed to a pressurised fluid jet.

A further object of the invention is to provide a method for deburring and/or cleaning a work piece which enables a work piece to be deburred and/or cleaned in a particularly efficient manner.

In accordance with the invention, this object is achieved in the case of a method for deburring and/or cleaning a work piece, wherein the work piece is dipped in a fluid medium and exposed to a high pressure fluid jet, in that a gas flow is produced which at least partially envelops the fluid jet.

Special embodiments and advantages of the method in accordance with the invention have already been described to some extent hereinabove in connection with the special embodiments and the advantages of the device in accordance with the invention. Consequently, reference will only be made in the following to those embodiments and advantages of the method in accordance with the invention which have not already been previously explained.

It is advantageous for the purposes of deburring and/or cleaning the work piece that the outlet from the chamber be positioned at a spacing of at most approximately 5 cm relative to a surface of the work piece which is to be cleaned and/or deburred. In particular, the spacing amounts to at most approximately 3 cm, preferably approximately 1 cm. The aforementioned spacings make it possible for the fluid jet together with the gas flow which at least partially envelops it to be supplied to the work piece that is to be cleaned and/or deburred without the gas flow envelope collapsing. Moreover, the aforementioned spacings make it possible for the fluid discharge device and the gas discharge device to be moved relative to the work piece without the necessity to adhere to the smallest of positional tolerances.

The device in accordance with the invention is suitable in particular for carrying out the method in accordance with the invention.

Further features and advantages of the invention form the subject matter of the following description and the graphical illustration of preferred exemplary embodiments.

BRIEF DESCRIPTION OF THE DRAWINGS

Similar or functionally equivalent elements are designated by the same reference symbols in each of the Figures.

DETAILED DESCRIPTION OF THE INVENTION

Figure 1:
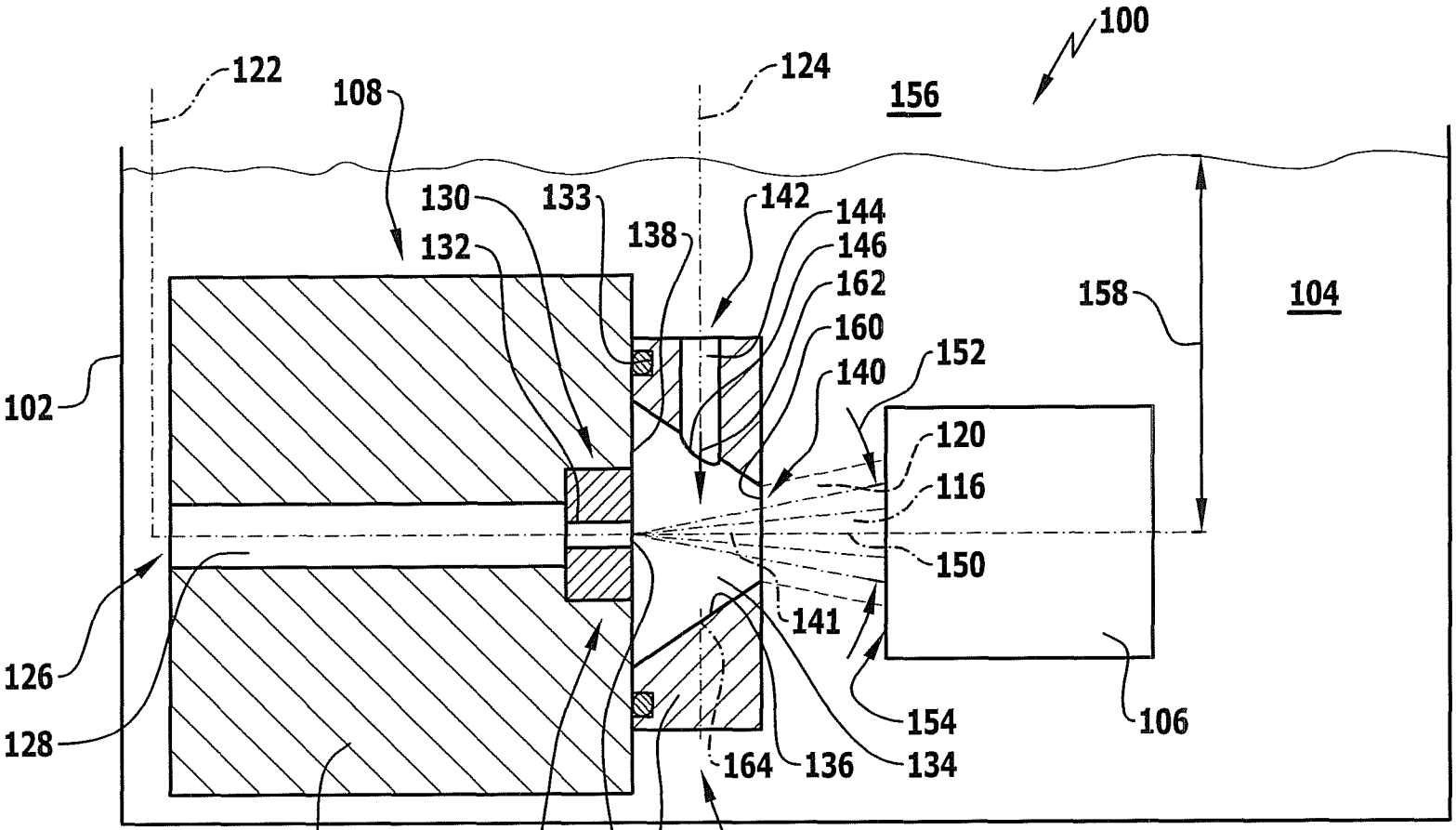
FIG. 1 shows a schematic section through a device in accordance with a first embodiment for deburring and/or cleaning a work piece dipped in a fluid medium.

A device for deburring and/or cleaning a work piece bearing the general reference 100 which is illustrated in FIG. 1 comprises a container 102 which contains a fluid medium 104. The fluid medium 104 is water for example.

The container 102 is dimensioned such that a work piece 106 requiring deburring and/or cleaning can be at least partially dipped in the fluid medium 104.

Moreover, the container 102 serves to accommodate a housing 108 which preferably consists of a plurality of parts and in particular, one which comprises a first housing part 110 and a second housing part 112.

The housing 108 serves for holding a fluid discharge device 114 that is used for producing a fluid jet 116. Furthermore, the housing 108 serves for holding a gas discharge device 118 that is used for the production of a gas flow 120 which at least partially envelops the fluid jet 116.

The device 100 comprises a fluid supply arrangement 122 which is indicated by a dash-dotted line and by means of which a high pressure fluid, in particular, water and/or an oil and/or an emulsion, is arranged to be supplied to the housing 108. For example, the fluid supply arrangement 122 comprises a high-pressure pump, which is not illustrated in the drawing, and a fluid supply line which supplies fluid to the housing 108.

Furthermore, the device 100 comprise a gas supply arrangement 124 which is indicated by a dash-dotted line and by means of which a gas, and in particular, air, is arranged to be supplied to the housing 108. For example, the gas supply arrangement 124 comprises a blower or a compressor, which is not illustrated in the drawing, and a gas supply line which supplies gas to the housing 108.

The first housing part 110 has an inlet 126 for a high pressure fluid which is adapted to be supplied via a line 128 to a nozzle body 130. The nozzle body 130 comprises a nozzle 132 with a nozzle cross sectional area which is reduced compared with the cross section of the line 128.

The second housing part 112 is connected in releasable manner to the first housing part 110 by means of connecting elements such as bolts for example which are not illustrated for reasons of clarity. Furthermore, the second housing part 112 is sealed in fluid-tight manner with respect to the first housing part 110 by means of a sealing element 133 which is in the form of an O-ring for example.

The second housing part 112 comprises a chamber 134 which is preferably in the form of a frustum of a cone. The chamber 134 comprises a peripheral chamber boundary surface 136 in the form of an outer wall of the truncated cone. The peripheral chamber boundary surface 136 extends between a substantially flat end face of a chamber boundary surface 138 which is formed by an end face of the first housing part 110, and an outlet 140 from the chamber. The cross section of the chamber taken perpendicularly with respect to the longitudinal axis 141 of the chamber tapers from the end face formed by the chamber boundary surface 138 in the direction of the outlet 140 from the chamber. The spacing between the end face formed by the chamber boundary surface 138 and the outlet 140 from the chamber amounts to approximately 2 cm for example. The second housing part 112 could also be referred to as a "casing nozzle".

The second housing part 112 has an inlet 142 for a gas which is provided by means of the gas supply arrangement 124. The inlet 142 preferably incorporates a standardized compressed air connector, of size R ¼ inch for example. The inlet 142 is connected in fluidic manner to a gas line 144. The gas line 144 opens out at a gas inlet 146 to the chamber through which the gas enters the chamber 134.

Furthermore, the chamber 134 has a fluid inlet 148 which is formed by an outlet of the nozzle 132.

The device 100 which has been described above functions as follows:

In preparation for the deburring and/or cleaning of a work piece 106, the container 102 is filled with a fluid medium 104. The work piece 106 and the housing 108 are then dipped into the fluid medium 104. For the purposes of producing a high pressure fluid jet 116, a fluid is supplied under high pressure to the housing 108 by means of the fluid supply arrangement 122. The fluid arrives at the nozzle 132 and the fluid inlet 148 to the chamber via the inlet 126 and the line 128. The fluid emerges from the nozzle 132 at the fluid inlet 148 to the chamber and forms the fluid jet 116. The fluid jet 116 extends along a jet axis 150 and has a beam angle 152 which is measured between mutually opposite peripheral boundaries of the fluid jet 116 and amounts to approximately 10° for example.

In order to prevent the fluid jet 116 from being slowed down by friction with the fluid medium 104 before it meets a surface 154 of the work piece 106 that is to be deburred and/or cleaned, there is produced a gas flow 120 which at least partially envelops the fluid jet 116. For this purpose, gas is supplied to the inlet 142 of the second housing part 112 by means of the gas supply arrangement 124 and this gas is introduced into the chamber 134 via the gas line 144 and the gas inlet 146 to the chamber. The gas entering the chamber 134 is subjected to a pressure. This pressure is preferably greater than the sum of the pressure prevailing in the environment 156 of the device 100 and the hydrostatic pressure at the height of the gas flow 120, this being determined by the immersion depth 158 which is measured between the level of the gas flow 120 and the surface of the fluid medium 104 ("bath level").

The outlet 140 from the chamber is of such a size that the fluid jet 116 emerging from the fluid inlet 148 to the chamber can be supplied through the chamber 134 to the outlet 140 from the chamber without the fluid jet 116 touching the peripheral chamber boundary surface 136. At the height level of the outlet 140 from the chamber, there is an annular gap 160 remaining between the periphery of the fluid jet 116 and the peripheral chamber boundary surface 136, this thereby allowing the gas entering the chamber 134 to escape through the outlet 140 from the chamber in the direction of the work piece 106. The peripherally closed enveloping gas flow 120 which prevents friction-induced deceleration of the fluid jet 116 in the fluid medium 104 is produced in this way.

In order to obtain a particularly good deburring and/or cleaning effect, it is advantageous for the housing 108 and the work piece 106 to be positioned relative to each other in such a manner that the spacing between the outlet 140 from the chamber and the surface 154 of the work piece 106 that is to be deburred and/or cleaned amounts to a maximum of approximately 3 cm, preferably, approximately 1 cm.

The spacing between the outlet of the nozzle 132 i.e. the fluid inlet 148 to the chamber on the one hand and the surface 154 of the work piece 106 requiring cleaning on the other amounts to a maximum of approximately 10 cm for example, preferably to a maximum of approximately 5 cm, and in particular, to between approximately 2 cm and approximately 3 cm.

The introduction of the gas into the chamber 134 is effected by means of the gas inlet 146 to the chamber in a gas entry direction 162 which is inclined with respect to the jet axis of the fluid jet 116, and in particular which is perpendicular thereto. The direction 162 in which the gas is introduced can run radially or tangentially relative to the jet axis 150.

It is possible for the gas to be fed into the chamber 134 by means of just one gas inlet 146 to the chamber. As an alternative thereto however, it is possible for at least one further gas inlet 164 to the chamber to be provided, this, for example, being arranged on the side of the peripheral chamber boundary surface 136 opposite to the gas inlet 146 to the chamber and being indicated in FIG. 1 by the dash-dotted lines.

Figure 2:
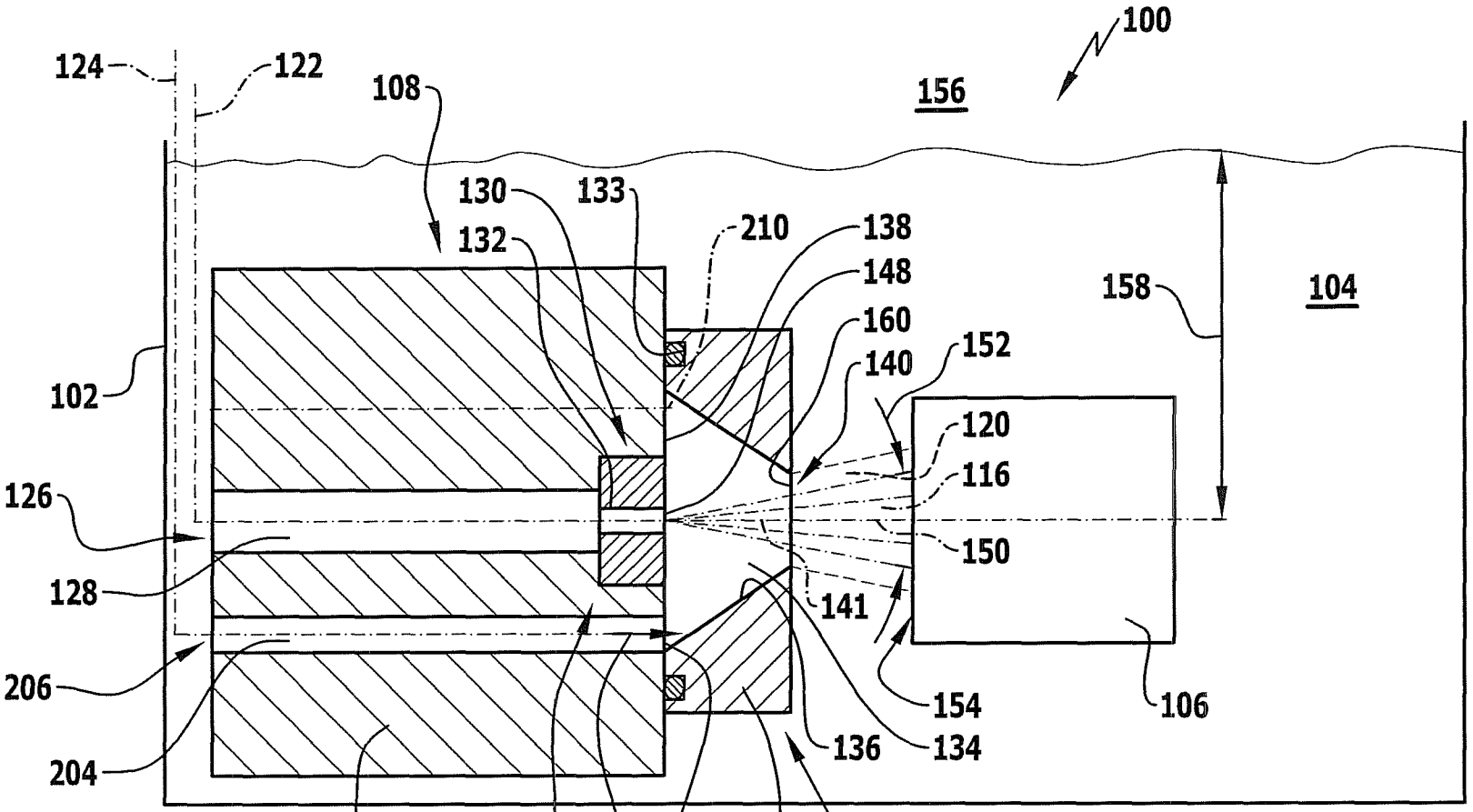
FIG. 2 a schematic section through a device in accordance with a second embodiment for deburring and/or cleaning a work piece dipped in a fluid medium.

A second embodiment of a device 100 for deburring and/or cleaning a work piece 106 that is dipped in a fluid medium 104 is illustrated in FIG. 2 and differs from the first embodiment illustrated in FIG. 1 in that the second embodiment has a gas inlet 202 to the chamber which is arranged together with the fluid inlet 148 to the chamber on the end face of the chamber boundary surface 138.

The gas inlet 202 to the chamber is fed by means of a gas line 204 which is arranged in the first housing part 110. The gas line 204 communicates with the gas supply arrangement 124 via an inlet 206.

A gas can be introduced into the chamber 134 in a direction 208 which is at least virtually parallel to the jet axis 150 of the fluid jet 116 by means of the gas inlet 202 to the chamber. The gas being introduced into the chamber 134 flows along the peripheral chamber boundary surface 136 to the outlet 140 from the chamber and there it emerges from the chamber 134 through the annular gap 160 and forms the envelope-like gas flow 120.

Even in the case where the gas is introduced into the chamber 134 in parallel with the jet axis 150 of the fluid jet 116, provision may be made for just a single gas inlet 202 to the chamber and or at least one further gas inlet 210 to the chamber may be provided as is indicated in FIG. 2 by a dash-dotted line. For example, the gas inlets 202 and 210 to the chamber are arranged on mutually opposite sides of the fluid inlet 148 to the chamber and are preferably located at the same distance from the fluid inlet 148 to the chamber.

In all other respects, the second embodiment of the device 100 illustrated in FIG. 2 is identical in regard to the construction and functioning thereof with the first embodiment illustrated in FIG. 1 and insofar reference should be made to the preceding description thereof.

A further embodiment of a device for deburring and/or cleaning a work piece that is dipped in a fluid medium but which is not illustrated in the drawing comprises at least one gas inlet 146 to the chamber by means of which a gas is adapted to be introduced into the chamber 134 in a gas entry direction 162 which is inclined with respect to the jet axis 150 of the fluid jet 116, and also at least one gas inlet 202 to the chamber by means of which a gas is adapted to be introduced into the chamber 134 substantially parallel to the jet axis 150 of the fluid jet 116.

The invention claimed is:

1. A device for deburring and/or cleaning a work piece which is dipped in a fluid medium, comprising a fluid discharge device for producing a high pressure fluid jet and a gas discharge device for the production of a gas flow which at least partially envelops the high pressure fluid jet, wherein the device comprises a housing incorporating a chamber, wherein the fluid discharge device comprises at least one fluid inlet to the chamber for an entry of the high pressure fluid jet into the chamber, and wherein the gas discharge device comprises at least one gas inlet to the chamber for an entry of gas into the chamber and at least one outlet from the chamber for an exit of the high pressure fluid jet and the gas flow, wherein the device comprises a gas supply arrangement for supplying the gas to the chamber under a pressure that is greater than a sum of a pressure prevailing in an environment of the device and a hydrostatic pressure at an immersion depth measured between a level of the gas flow and a surface of the fluid medium, wherein the device is configured such that the high pressure fluid jet exiting the chamber widens at a beam angle of 25° or less at the outlet from the chamber and is enveloped by the gas flow which also widens at the outlet from the chamber and wherein the outlet from the chamber is of such a size that an annular gap remains between a periphery of the high pressure fluid jet and a peripheral chamber boundary surface at the outlet from the chamber so that the gas entering the chamber forms the gas flow enveloping the high pressure fluid jet and the high pressure fluid jet does not come into direct contact with the fluid medium in the vicinity of the fluid discharge device, so that cavitation is prevented.

2. A device in accordance with claim 1, wherein the gas discharge device is configured for introducing at least a part of the gas into the chamber substantially parallel to a jet axis of the high pressure fluid jet.

3. A device in accordance with claim 1, wherein the gas discharge device is configured for introducing at least a part of the gas into the chamber in a gas entry direction which is inclined with respect to a jet axis of the high pressure fluid jet.

4. A device in accordance with claim 1, wherein a longitudinal axis of the chamber runs substantially parallel to a jet axis of the high pressure fluid jet.

5. A device in accordance with claim 1, wherein the housing comprises a first housing part for a disposition of the fluid discharge device and a second housing part which bounds at least a section of the chamber and which is connected to or is connectable to the first housing part.

6. A method for deburring and/or cleaning a work piece, comprising:

dipping the work piece in a fluid medium and exposing the work piece to a high pressure fluid jet produced by a fluid discharge device;

producing a gas flow which at least partially envelops the high pressure fluid jet;

discharging the high pressure fluid jet together with the gas flow from a chamber through an outlet from the chamber, wherein the gas entering the chamber is subjected to a pressure that is greater than a sum of a pressure prevailing in an environment of the device and a hydrostatic pressure at an immersion depth measured between a level of the gas flow and a surface of the fluid medium, wherein the high pressure fluid jet exiting the chamber widens at a beam angle of 25° or less at the outlet from the chamber and is enveloped by the gas flow which also widens at the outlet from the chamber and wherein the high pressure fluid jet does not come into direct contact with the fluid medium in the vicinity of the fluid discharge device, so that cavitation is prevented.

7. A method in accordance with claim 6, wherein at least a part of a gas is introduced into the chamber substantially parallel to a jet axis of the high pressure fluid jet.

8. A method in accordance with claim 6, wherein at least a part of a gas is introduced into the chamber in a gas entry direction that is inclined with respect to a jet axis of the high pressure fluid jet.

9. A method in accordance with claim 6, wherein the outlet from the chamber is positioned at a spacing of at most 5 centimeters relative to a surface of the work piece which is to be cleaned and/or deburred.

10. A device for deburring and/or cleaning a work piece which is dipped in a fluid medium, comprising:

a fluid discharge device for producing a high pressure fluid jet and a gas discharge device for the production of a gas flow which at least partially envelops the high pressure fluid jet, wherein the device comprises a housing incorporating a chamber, wherein the fluid discharge device comprises at least one fluid inlet to the chamber for an entry of the high pressure fluid jet into the chamber, and wherein the gas discharge device comprises at least one gas inlet to the chamber for an entry of gas into the chamber and at least one outlet from the chamber for an exit of the high pressure fluid jet and the gas flow, wherein the chamber is substantially in the form of a frustum of a cone, wherein an angle between an outer surface of the frustum of the cone and an axis of the high pressure fluid jet is between about 10° and 60°, wherein the at least one gas inlet to the chamber opens out at the outer surface of the frustum of the cone, wherein a chamber cross section of the chamber extending perpendicularly to a longitudinal axis of the chamber tapers towards the outlet from the chamber, wherein the device comprises a gas supply arrangement for supplying the gas to the chamber under a pressure that is greater than a sum of a pressure prevailing in an environment of the device and a hydrostatic pressure at an immersion depth measured between a level of the gas flow and a surface of the fluid medium, and wherein the outlet from the chamber is of such a size that an annular gap remains between a periphery of the high pressure fluid jet and a peripheral chamber boundary surface at the outlet from the chamber so that the gas entering the chamber forms the gas flow enveloping the high pressure fluid jet and the high pressure fluid jet does not come into direct contact with the fluid medium in the vicinity of the fluid discharge device, so that cavitation is prevented, wherein the device is configured such that the high pressure fluid jet exiting the chamber widens at the outlet from the chamber and is enveloped by the gas flow which also widens at the outlet from the chamber.

11. A device for deburring and/or cleaning a work piece which is dipped in a fluid medium, comprising:

a fluid discharge device for producing a high pressure fluid jet and a gas discharge device for the production of a gas flow which at least partially envelops the high pressure fluid jet, wherein the device comprises a housing incorporating a chamber, wherein the fluid discharge device comprises at least one fluid inlet to the chamber for an entry of the high pressure fluid jet into the chamber, and wherein the gas discharge device comprises at least one gas inlet to the chamber for an entry of gas into the chamber and at least one outlet from the chamber for an exit of the high pressure fluid jet and the gas flow, wherein the device comprises a gas supply arrangement for supplying the gas to the chamber under a pressure of 10 bar at the most, said pressure being greater than a sum of a pressure prevailing in an environment of the device and a hydrostatic pressure at an immersion depth measured between a level of the gas flow and a surface of the fluid medium, wherein the device is configured such that the high pressure fluid jet exiting the chamber widens at the outlet from the chamber and is enveloped by the gas flow which also widens at the outlet from the chamber, and wherein the outlet from the chamber is of such a size that an annular gap remains between a periphery of the high pressure fluid jet and a peripheral chamber boundary surface at the outlet from the chamber so that the gas entering the chamber forms the gas flow enveloping the high pressure fluid jet and the high pressure fluid jet does not come into direct contact with the fluid medium in the vicinity of the fluid discharge device, so that cavitation is prevented.

12. A device for deburring and/or cleaning a work piece which is dipped in a fluid medium, comprising:

a fluid discharge device for producing a high pressure fluid jet and a gas discharge device for the production of a gas flow which at least partially envelops the high pressure fluid jet, wherein the device comprises a housing incorporating a chamber, wherein the fluid discharge device comprises at least one fluid inlet to the chamber for an entry of the high pressure fluid jet into the chamber, and wherein the gas discharge device comprises at least one gas inlet to the chamber for an entry of gas into the chamber and at least one outlet from the chamber for an exit of the high pressure fluid jet and the gas flow, wherein the device comprises a container which is filled with the fluid medium up to a surface of the fluid medium and accommodates the housing holding the fluid discharge device and the gas discharge device, the container being dimensioned such that the work piece can be at least partially dipped in the fluid medium contained in the container during the deburring or cleaning of the work piece, wherein the device comprises a gas supply arrangement for supplying the gas to the chamber under a pressure that is greater than a sum of a pressure prevailing in an environment of the device and a hydrostatic pressure at an immersion depth measured between a level of the gas flow and a surface of the fluid medium, and wherein the outlet from the chamber is of such a size than an annular gap remains between a periphery of the high pressure fluid jet and a peripheral chamber boundary surface at the outlet from the chamber so that the gas entering the chamber forms the gas flow enveloping the high pressure fluid jet and the high pressure fluid jet does not come into direct contact with the fluid medium in the vicinity of the fluid discharge device, so that cavitation is prevented, wherein the device is configured such that the high pressure fluid jet exiting the chamber widens at the outlet from the chamber and is enveloped by the gas flow which also widens at the outlet from the chamber.

13. A method for deburring and/or cleaning a work piece, comprising:

dipping the work piece in a fluid medium and exposing the work piece to a high pressure fluid jet produced by a fluid discharge device;

producing a gas flow which at least partially envelops the high pressure fluid jet;

discharging the high pressure fluid jet together with the gas flow from a chamber having at least one fluid inlet for an entry of the high pressure fluid jet into the chamber and at least one gas inlet for an entry of gas into the chamber, through an outlet from the chamber;

wherein the chamber is substantially in the form of a frustum of a cone, wherein an angle between an outer surface of the frustum of the cone and an axis of the high pressure fluid jet is between about 10° and 60°, wherein the at least one gas inlet opens out at the outer surface of the frustum of the cone, wherein a chamber cross section of the chamber in a direction perpendicular to a longitudinal axis of the chamber tapers towards the outlet from the chamber, wherein the gas entering the chamber is subjected to a pressure that is greater than a sum of a pressure prevailing in an environment of the device and a hydrostatic pressure at an immersion depth measured between a level of the gas flow and a surface of the fluid medium, and wherein the high pressure fluid jet does not come into direct contact with the fluid medium in the vicinity of the fluid discharge device, so that cavitation is prevented, wherein the high pressure fluid jet exiting the chamber widens at the outlet from the chamber and is enveloped by the gas flow which also widens at the outlet from the chamber.

14. A method for deburring and/or cleaning a work piece, comprising:

dipping the work piece in a fluid medium and exposing the work piece to a high pressure fluid jet produced by a fluid discharge device;

producing a gas flow which at least partially envelops the high pressure fluid jet;

discharging the high pressure fluid jet together with the gas flow from a chamber through an outlet from the chamber;

wherein the gas entering the chamber is subjected to a pressure of 10 bar at the most, said pressure being greater than a sum of a pressure prevailing in an environment of the device and a hydrostatic pressure at an immersion depth measured between a level of the gas flow and a surface of the fluid medium, and wherein the high pressure fluid jet does not come into direct contact with the fluid medium in the vicinity of the fluid discharge device, so that cavitation is prevented, wherein the high pressure fluid jet exiting the chamber widens at the outlet from the chamber and is enveloped by the gas flow which also widens at the outlet from the chamber.

15. A device in accordance with claim 1, wherein the chamber into which the high pressure fluid jet enters through the at least one fluid inlet and into which the gas enters through the at least one gas inlet is substantially in the form of a frustum of a cone, wherein an angle between an outer surface of the frustum of the cone and an axis of the high pressure fluid jet amounts to between 10° and 60°, wherein the at least one gas inlet to the chamber opens out at the outer surface of the frustum of the cone, wherein a chamber cross section of the chamber extending perpendicularly to a longitudinal axis of the chamber tapers towards the outlet from the chamber, wherein the gas supply arrangement is configured to supply the gas to the chamber under a pressure of 10 bar at the most and wherein the device comprises a container which is filled with the fluid medium up to a surface of the fluid medium and accommodates the housing holding the fluid discharge device and the gas discharge device, the container being dimensioned such that the work piece can be at least partially dipped in the fluid medium contained in the container during the deburring or cleaning of the work piece.

16. A method in accordance with claim 6, wherein the chamber has at least one fluid inlet for an entry of the high pressure fluid jet into the chamber and at least one gas inlet for an entry of the gas into the chamber, wherein the chamber is substantially in the form of a frustum of a cone, wherein an angle between an outer surface of the frustum of the cone and an axis of the high pressure fluid jet amounts to between 10° and 60°, wherein the at least one gas inlet opens out at the outer surface of the frustum of the cone, wherein the gas entering the chamber is subjected to a pressure of 10 bar at the most and wherein a device comprising a housing holding the fluid discharge device and the gas discharge device further comprises a container which is filled with the fluid medium up to a surface of the fluid medium and accommodates the housing holding the fluid discharge device and the gas discharge device, wherein the work piece is at least partially dipped in the fluid medium contained in the container during the deburring or cleaning of the work piece.

* * * * *